United States Patent [19]

Noakes

[11] Patent Number: 4,801,086

[45] Date of Patent: Jan. 31, 1989

[54] SPRAYING APPARATUS

[75] Inventor: Timothy J. Noakes, Hampshire, England

[73] Assignee: Imperial Chemical Industries PLC, London, England

[21] Appl. No.: 201,330

[22] Filed: May 31, 1988

Related U.S. Application Data

[63] Continuation of Ser. No. 830,874, Feb. 19, 1986, abandoned.

[30] Foreign Application Priority Data

Feb. 19, 1985 [GB] United Kingdom ..... 8504254

[51] Int. Cl.[4] ..... B05B 5/02

[52] U.S. Cl. ..... 239/3; 239/8; 239/419.3; 239/424; 239/549; 239/696; 239/707

[58] Field of Search ..... 239/3, 8, 690, 696, 239/704, 706, 707, 708, 419.3, 422, 424, 549, 568, 555

[56] References Cited

U.S. PATENT DOCUMENTS 4,356,528 10/1982 Coffee ..... 239/690

4,467,961 8/1984 Coffee et al. ..... 239/3

*Primary Examiner*—Andres Kashnikow

*Assistant Examiner*—Michael J. Forman

*Attorney, Agent, or Firm*—Cushman, Darby & Cushman

[57] ABSTRACT

An apparatus and process for the electrostatic spraying of a mixture of a plurality of liquids, suitably liquids which react together rapidly to form a solid, liquids which are physically imcompatible, or liquids, such as paints, to provide novel optical effects. The apparatus includes a sprayhead formed with a plurality of channels which communicate with a common outlet means. The liquids are supplied to respective channels and meet at the outlet means. There they are subjected to an electrical field which causes a mixture of the liquids to be drawn from the sprayhead in the form of one or more filaments, the or each filament constaining a mixture of liquids in the proportions equal or substantially equal to the proportions in which the liquids were supplied to the sprayhead.

26 Claims, 6 Drawing Sheets

16
5
1
7
2
2
B
15
13
A
20
V

SPRAYING APPARATUS

This is a continuation of application Ser. No. 830,874, filed Feb. 19, 1986, which was abandoned upon the filing hereof.

This invention relates to electrostatic spraying.

It is sometimes necessary to coat articles with a material formed from a mixture of liquids which react together rapidly to form a solid, or to make articles in a particular form, for example beads or filaments, from a mixture of such liquids. There are other processes which involve subjecting a liquid to some treatment for which its physical properties are unsuitable, in which case the liquid may be mixed with a carrier liquid of suitable properties. On other occasions liquids must be mixed and processed in a manner which causes undesirable changes in the properties of one of the liquids. Finally, it is sometimes desirable to mix differently coloured liquids, such as paints, in order to produce novel optical effects on a target.

In each of these cases there is a need for an apparatus wherein mixing of the liquids is delayed for as long as possible before the final processing of the mixture takes place.

According to the invention there is provided an apparatus for the electrostatic spraying of a plurality of liquids, the apparatus comprising a sprayhead formed with a plurality of channels each communicating with an outlet means at which liquids flowing through respective channels meet, and means for subjecting liquids emerging from the outlet means to an electrical field sufficiently high for a mixture of liquids to be drawn from the sprayhead in the form of at least one filament, the or each filament containing a mixture of liquids in proportions equal or substantially equal to the proportions in which they were supplied to the apparatus.

The sprayhead may comprise a series of mutually spaced plates, each channel being formed by the space between a pair of adjacent plates.

In this case, the sprayhead may comprise a central plate and two outer plates, a channel is formed between each outer plate and the central plate, and the outlet means comprises an outlet edge of each of the plates, the outlet edge of the central plate being located downstream of the outlet edges of respective outer plates.

Suitably, the angle which is included between opposed sides of the central plate at the outlet edge thereof is smaller than the included angle between outer sides of respective outer plates.

Preferably, the said angle between opposed sides of the central plate is between 10° and 60°, and the angle between outer sides of respective outer plates is between 80° and 150°.

Alternatively, the sprayhead may comprise a series of coaxially arranged, generally tubular elements, and each channel is formed by a space of generally annular section between two adjacent elements.

The sprayhead may then comprise radially inner, intermediate and outer guide elements, and the outlet means comprises axially outer edges of respective elements, the axially outer edge of the intermediate element being located downstream of the axially outer edges of the inner and outer elements.

Suitably, the angle which, in an axial section of the sprayhead, is included between opposed sides of the intermediate element at the axially outer edge thereof is smaller than the angle between a radially outer side of the outer element and a radially inner side of the inner element.

Preferably, the said angle between opposed sides of the intermediate element is between 10° and 60°, and the said angle between the radially outer side of the outer element and the radially inner side of the inner element is between 80° and 150°.

Suitably, the outlet means comprises a surface of conducting or semi-conducting material, and the means for subjecting the liquids to an electrical field comprise means for applying an electrical potential to the said surface. Alternatively, the outlet means may be formed of non-conducting material and an electrode may be arranged a short distance upstream of the outlet means and at a location such that the electrode is contacted, in use, by at least one of the liquids, the means for subjecting the liquids to an electrical field comprising means for applying an electrical potential to the said electrode.

Preferably, an electrode is mounted adjacent the sprayhead, and the means for subjecting liquids emerging from the outlet means to an electric field comprise means for causing a first potential to be applied to the liquids, and means for maintaining the electrode at a second potential, the difference between the first and second potentials being sufficient to cause formation of the said filament or filaments.

When spraying a target at zero potential, the first potential may be 1 to 20 KV and the second potential may be at or near earth potential, as disclosed in our UK specification No. 1.569.707.

Alternatively, when spraying a target at zero potential, the first potential is 25 to 50 KV, and the second potential is 10 to 40 KV, as disclosed in our co-pending UK application No. 8432274.

Preferably, the electrode comprises a core of conducting or semi-conducting material sheathed in a material of dielectric strength and volume resistivity sufficiently high to prevent sparking between the electrode and the sprayhead and volume resistivity sufficiently low to allow charge collected on the surface of the sheathing material to be conducted through that material to the conducting or semi-conducting core. Suitably, the volume resistivity of the sheathing material is between $5\times10^{11}$ and $5\times10^{13}$ ohm cms., the dielectric strength of the sheathing material is greater than 15 KV/mm and thickness of the sheathing material is 0.75 to 5.00 mms., preferably 1.5 to 3 mms. Sheathed electrodes of this form are also disclosed in our co-pending UK application No. 8432274.

Means may be provided for supplying the plurality of liquids to the sprayhead so that the or each filament becomes unstable and breaks-up into charged droplets a short distance away from the outlet means.

In this case, means may be provided for causing a stream of gas to flow through the region of the high electrical field, the direction and velocity of the stream of gas being such that charged droplets of liquid are removed from the said region, thereby to reduce a build-up in space charge which affects the magnitude of the electrical field. The velocity of the stream of gas may be approximately equal to or greater than the velocity of the droplets in the absence of the stream of gas. Spraying apparatus in which such a stream of gas is employed is disclosed in our co-pending UK application No. 8504253.

Alternatively, means may be provided for supplying the plurality of liquids to the sprayhead so that the mixture of liquids remains in the form of a filament or filaments until striking a target.

In apparatus where a stream of gas is provided the target and the above-mentioned first potential may both be at earth potential and the second potential above 5 KV.

According to the invention there is also provided a process for the electrostatic spraying of a plurality of liquids comprising supplying the liquids to respective channels in a sprayhead, each channel communicating with an outlet means at which the liquids flowing through respective channels meet, and subjecting liquids emerging from the outlet means to an electrical field sufficiently high for a mixture of liquids to be drawn from the sprayhead in the form of at least one filament, the or each filament containing a mixture of liquids in proportions equal to the proportions in which they were supplied.

The invention will now be described, by way of example, with reference to the accompanying drawings, in which.

Figure 1:
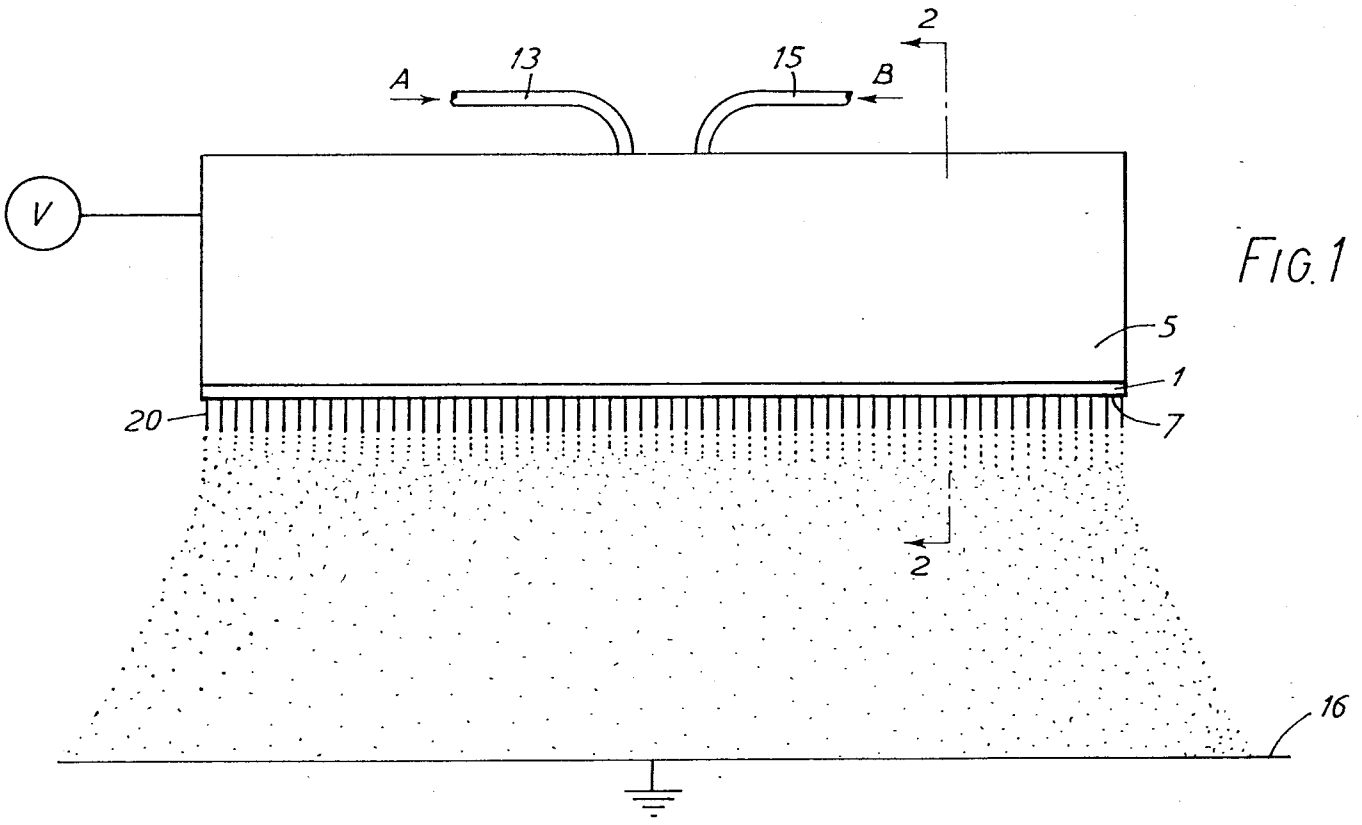
FIG. 1 is a diagrammatic side elevation of a sprayhead in a first electrostatic spraying apparatus according to the invention.
Figure 3:
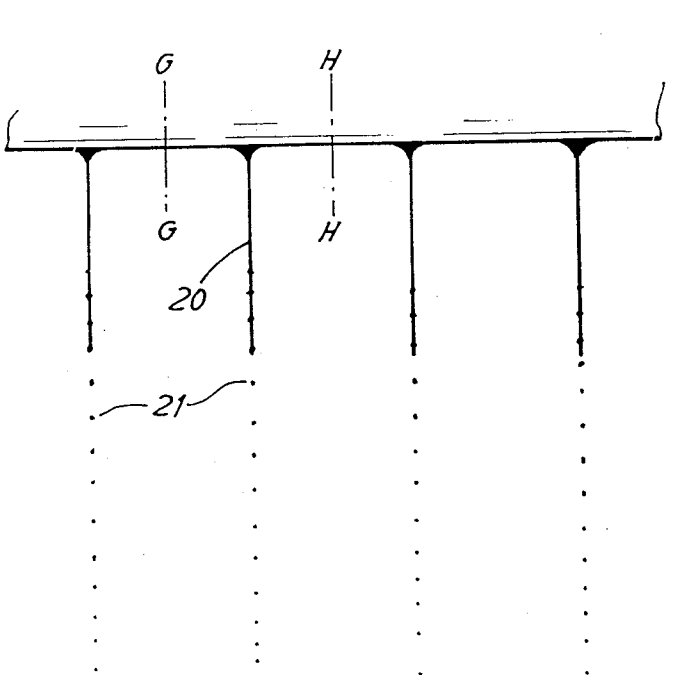
FIG. 3 is an enlarged side elevation of a part of the sprayhead of FIGS. 1 and 2.
Figure 2:
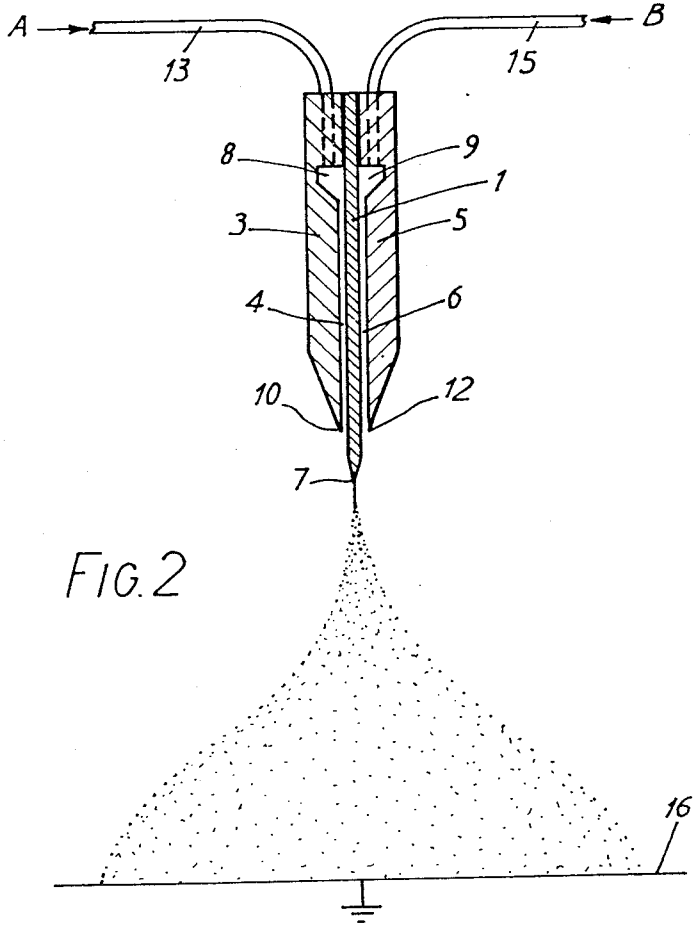
FIG. 2 is a section on the line I—I of FIG. 1.

The sprayhead shown in FIGS. 1 to 3 of the drawings is suitable for spraying two liquids.

Referring to FIGS. 1 to 3, the present sprayhead includes three mutually spaced, parallel arranged plates, a central plate 1 and two outer plates 3 and 5. A supply channel for liquid is formed by the space between each pair of adjacent plates. Thus, the space between the plates 1 and 3 forms a first channel 4, associated with which is a distribution gallery 8 and an inlet pipe 13. A second channel 6 is formed by the space between the plates 1 and 5 and has an associated gallery 9 and inlet pipe 15. Each of the channels 4 and 6 is approximately 150 μm wide. As shown in FIG. 2, a lower outlet edge 7 of the central plate 1 is sharp and is located a short distance below or downstream of the lower outlet edges 10 and 12 of respective outer plates 3 and 5. The region containing the lower edges 10 and 12 of the outer plates 3 and 5 and the lower edge 7 of the central plate 1 serves as an outlet means for the sprayhead.

Each of the plates 1, 2 and 3 is made of conducting or semi-conducting material, including the surfaces of these plates in the outlet means. The plates are connected to an output terminal of a voltage generator (not shown) which provides an output voltage of approximately 40 KV.

In use, an article 16 which is to be coated is maintained at earth potential and is disposed approximately 5 cms below the sprayhead, as shown in FIGS. 1 and 2. The generator is switched on, liquid from a first supply tank is supplied to the sprayhead via the inlet pipe 13, and liquid from a second supply tank is supplied to the sprayhead via the inlet pipe 15.

A liquid A from the inlet pipe 13 flows into the gallery 8 and then downwardly through the channel 4 whilst a liquid B from the inlet pipe 15 flows into the gallery 9 and downwardly via the channel 6. Upon reaching the outlet means of the sprayhead, the liquid A from the channel 4 moves past the lower outlet edge 10 of the outer plate 3 and then flows downwardly across one face of the central plate 1. Liquid B from the channel 6 moves past the lower outlet edge 12 of the outer plate 5 and then flows downwardly across an opposite face of the central plate 1. The liquids A and B mix together once they reach the lower outlet edge 7 of the central plate 1.

The potential which is applied to the plates 1, 3 and 5 from the generator produces an electrostatic field of high intensity (approximately 8 KV/cm) between the lower edge 7 of the central plate 1. The effect of this field is to draw the liquids A and B emerging from the edge 7 into a series of mutually spaced filaments 20, as shown in FIG. 1 of the drawings. The spacing between adjacent filaments 20 is determined by the magnitude of the electrostatic field, the properties of the liquids, and the flow rates, Mixing occurs because all of the liquids from the channels 4 and 6 which flows downwardly between the lines G—G and H—H of FIG. 3 is drawn into the filament 20 between those two lines.

As shown in FIG. 3, the mixed liquids A and B in each filament 20 subsequently break-up into droplets 21 due to the instability of the liquid jet in air.

Figure 4:
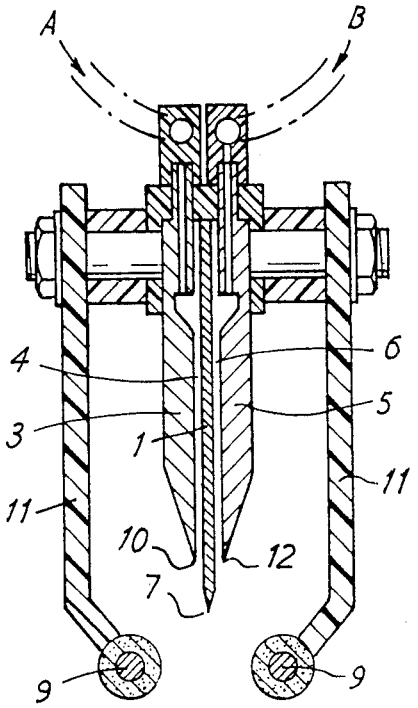
FIGS. 4 to 13 are schematic drawings of sprayheads in further electrostatic spraying apparatus according to the invention.

The sprayhead of FIG. 4 corresponds to the sprayhead of FIG. 2 in that there is again a central plate 1 and two outer plates 3 and 5, respectively, which define supply channels 4 and 6 for respective first and second liquids. As shown, an outlet edge 7 of the central plate 1 is sharp and is located a short distance below or downstream of the outlet edges 10 and 12 of respective plates 3 and 5.

The present sprayhead differs from the sprayhead of FIG. 2 in that two mutually spaced, parallel arranged electrode elements are disposed adjacent to the outlet edge 7 of the central plate 1. Each of the electrode elements 9 extends parallel to the edge 7 and each electrode element is supported by an insulating arm 11. Each element 9 has a core of conducting or semi-conducting material sheathed in a material of dielectric strength greater than 15 KV/mm., volume resistivity between $5\times10^{11}$ and $5\times10^{13}$ ohm. cms., and thickness 0.75 to 5 mms. This is sufficient to prevent sparking between the electrode elements and the sprayhead. On the other hand, the volume resistivity is sufficiently low to allow charge collected on the surface of the sheathing material to be conducted through that material to the core. The specific resistance of the sheathing material is between $5\times10^{10}$ and $5\times10^{12}$.

There is a spacing of 5 to 10 mms between each electrode element 9 and the outlet edge 7 and the two elements 9 are spaced apart by approximately 8 to 20 mms.

In use, a target is again maintained at earth potential, the plates 1, 3 and 5 are maintained at an electrical potential of 25 to 50 KV, and the electrode elements 9 are maintained at a potential of 10 to 40 KV. Alternatively, the plates 1, 3 and 5 can be maintained at 1 to 20 KV and the elements 9 at or near earth potential.

As with the sprayhead of FIG. 2, the liquids from the channels 4 and 6 flow downwardly on respective opposite faces of the plate 1 before meeting at the edge 7, where they mix. The presence of the electrodes 9 serves to intensify the elecrostatic field at the edge 7, and hence to improve atomisation of the mixture of liquids emerging from that edge.

Figure 5:
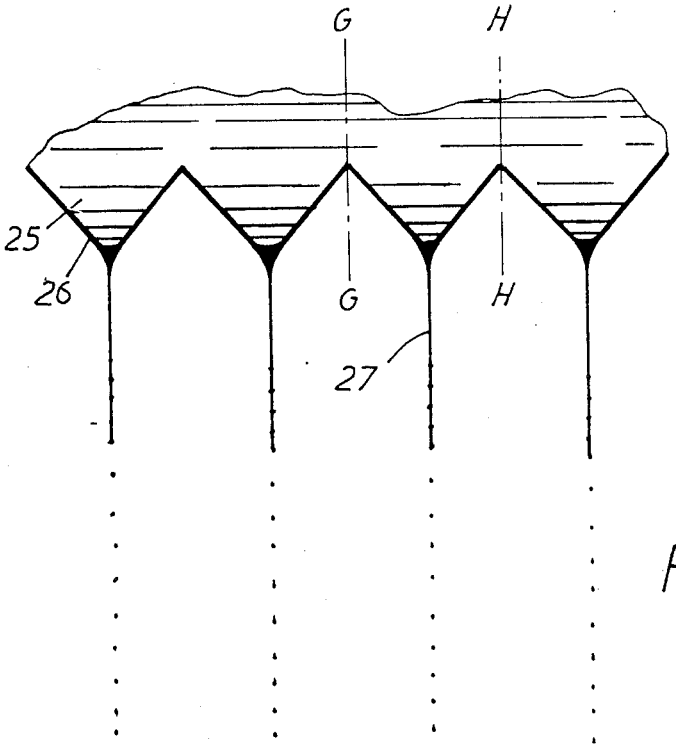

FIG. 5 of the drawings shows a side elevation of a sprayhead in a further apparatus according to the invention. The sprayhead of FIG. 5 corresponds to the sprayhead of FIG. 2 except that a central plate 25 of the sprayhead has an outlet edge 26 which is toothed rather than straight. As shown in FIG. 5, one filament 27 is now formed at each tooth, unless the teeth are too close together, when some teeth will not have filaments, or too far apart, when some teeth may have more than one filament.

Figure 6:
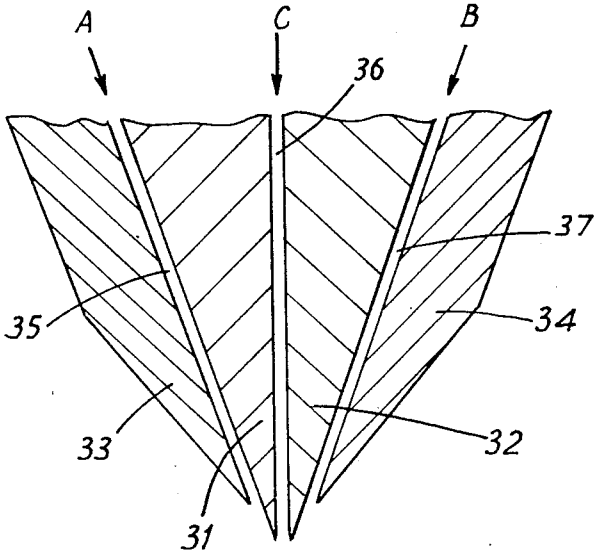

Referring now to FIG. 6, a further sprayhead in apparatus according to the invention is designed for mixing three liquids. The sprayhead includes two inner plates 31 and 32 and two outer plates 33 and 34, which together define three channels 35, 36 and 37 for respective liquids. The inner plates 31 and 32 have outlet edges which are sharp and which are located a short distance downstream or below the oulet edges of the outer plates 33 and 34.

In use, the liquid which is supplied to the channel 35 moves past the lower edge of the outer plate 33 and then flows downwardly on one face of the inner plate 31 to the outlet edge of that plate. Liquid from the channel 37 likewise flows downwardly to the outlet edge of the inner plate 32. At the outlet edges of the inner plates 31 and 32 the liquids from channels 35 and 37 meet and mix with the liquid flowing down the channel 36.

Figure 7:
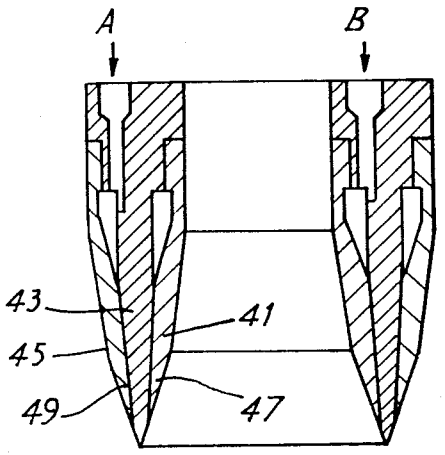

FIG. 7 of the drawings shows a sprayhead which has an annular outlet means as compared with the linear outlet means of the sprayheads of FIGS. 1 to 6.

Referring to FIG. 7, the sprayhead is formed of radially inner, intermediate and outer elements 41, 43 and 45, respectively, each of which is generally tubular in shape. The elements 41, 43 and 45 are coaxially arranged so that a first channel 47 is formed between the elements 41 and 43 and a second channel 49 is formed between the elements 43 and 45. The intermediate element 43 is arranged with its lower outlet edge a short distance below the outlet edges of the inner element 41 and the outer element 45.

In the sprayhead of FIG. 7, mixing of liquids supplied to the channels 47 and 49, respectively, takes place at the outlet edge of the intermediate element 43, in the manner described above.

Figure 8:
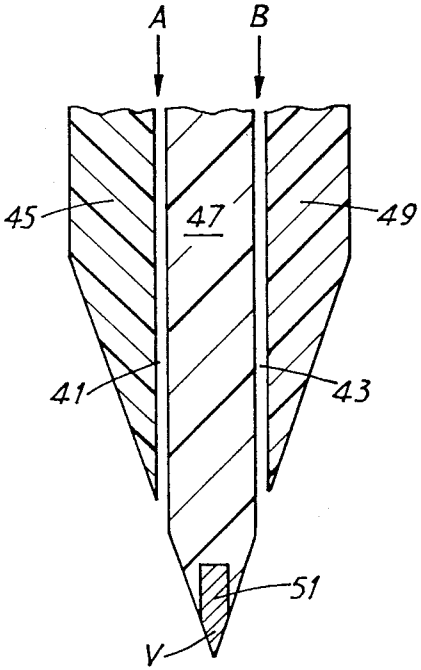

FIG. 8 of the drawings shows a further sprayhead in which channels 41 and 43 for liquids are defined by upstanding plates 45, 47 and 49 of insulating material. In this case an electrode 51 is formed by a metal insert at a lower edge of the plate 47 and an intense electrostatic field is developed at the lower edge by applying a suitable potential to the electrode.

In the sprayhead of FIG. 9 there are again three plates of insulating material defining two channels for liquids. In this case, electrodes 51 and 53, each contacting the liquid in a respective one of the channels, are provided for use in developing an intense electrostatic field at the lower edge of the central plate.

Figure 9:
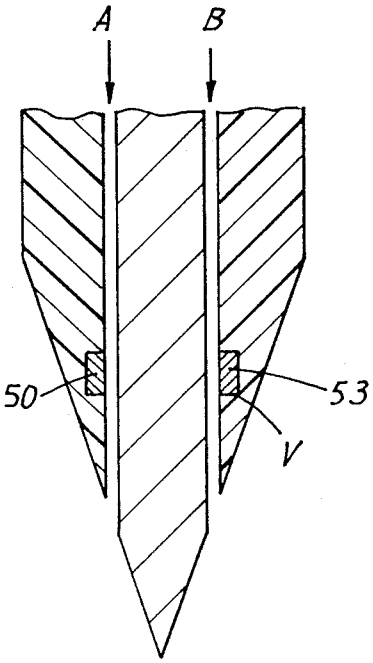

The apparatus of FIG. 9 can be modified by using only one of the electrodes 51 and 53.

Figure 10:
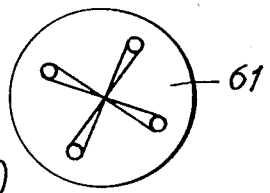
Figure 11:
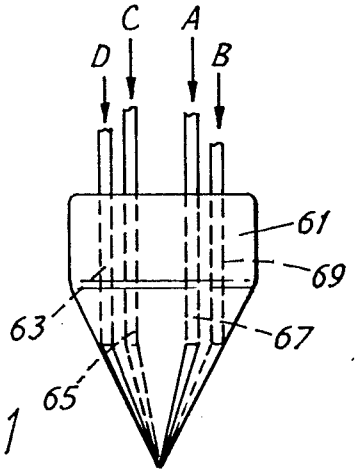

FIGS. 10 and 11 show a sprayhead having a body 61 of conducting material which has a generally conical tip and is formed with four channels 63, 65, 67 and 69 for liquids. Each of the channels 63 to 69 extends downwardly through the body 61 to an outlet at the tip.

In use, four liquids are supplied to respective channels 63, 65, 67 and 69 and meet at the tip of the body 61. At the tip the liquids mix and are subjected to an electrostatic field which causes them to be drawn into filaments.

Figure 12:
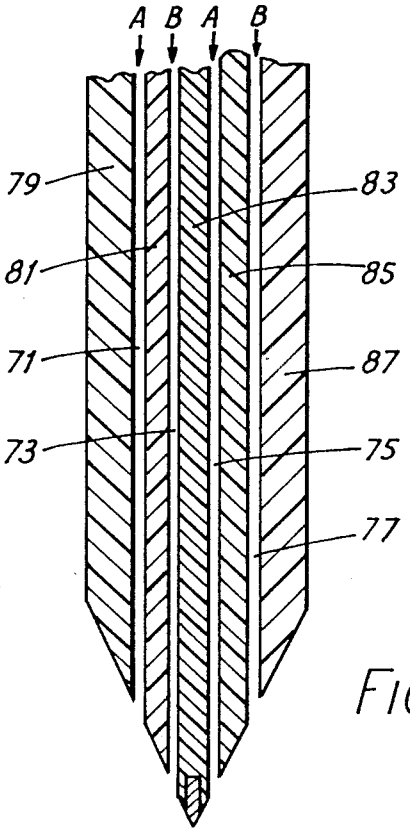

FIG. 12 is a sprayhead suitable for mixing two liquids A and B whose physical properties make it difficult to obtain thorough mixing. In the apparatus of FIG. 12 there are four channels 71, 73, 75 and 77 defined by upstanding plates 79, 81, 83, 85 and 87. The plates 79 to 87 are made of insulating material and an electrode 89 is therefore provided at a lower outlet edge of the central plate 83.

In use, a first liquid A is supplied to the channels 71 and 75 and a second liquid B is supplied to the channels 73 and 77. The liquids A and B in respective channels 71 and 73 meet at a lower outlet edge of the plate 81 and the liquids A and B in respective channels 77 and 75 likewise meet at a lower outlet edge of the plate 85. Mixing begins as the liquids then flow down on respective opposite sides of the plate 83 and is continued when the two partial mixtures meet at the lower edge of that plate. The liquids are then subjected to an intense electrical field which effects atomisation.

The sprayhead of FIG. 12 can also be used for mixing four different liquids, such as paints, to produce a desired optical effect on a target. In this case liquids A, B, C and D are supplied to respective channels 71, 73, 75 and 77.

Figure 13:
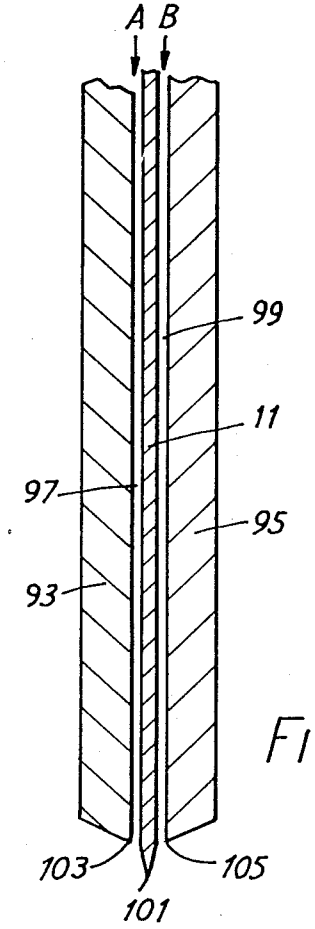

FIG. 13 is a sprayhead according to the invention which is also particularly suitable for mxing liquids where difficulties are experienced in obtaining thorough mixing.

In this connection, it will be appreciated that any two liquids which flow into the outlet means of the sprayheads described above are charged to the same polarity as they move towards the location at which one of the liquids contacts the other. For example, in the sprayhead of FIGS. 1 to 3 the liquids flowing downwardly on respective opposite sides of the central plate 1 are charged to the same polarity as they approach the outlet edge 7 of that plate. In the result, there is a tendency for the liquids to repel one another as they meet at the edge 7. Indeed, in extreme cases the two liquids may emerge from the edge 7 as separate stream.

To overcome this problem it is possible to employ plates of insulating material, as in FIG. 9 for example, and to provide an electrode in only one of the channels between the plates. One of the liquids is then charged and the other is uncharged. Unfortunately, however, this may result in the charged liquid being deflected sideways as it moves downwardly past the electrode elements adjacent the sprayhead.

It has now been appreciated that there are two conflicting requirements in designing a sprayhead which will overcome this problem.

On the one hand, providing a central plate with a sharp outlet edge (i.e. a small included angle between respective opposite sides of the plate at the outlet edge thereof) results in a more intense electrical field in the immediate vicinity of the sprayhead. This improves atomisation. On the other hand, the sharpness of the outlet edge has the result that there is a wide range of angular directions along which there is a high potential gradient. There is therefore a tendency for liquid emerging from the sprayhead to be dispersed over a wide angle.

Against this, a blunt outlet edge (i.e. an outlet edge having a large included angle between respective opposite sides of the plate at the outlet edge) results in a less intense electrical field but a well directed stream of liquids.

Referring now to FIG. 13, a further sprayhead according to the invention has a central plate 91 and two other plates 93 and 95, providing channels 97 and 99. An outlet edge 101 of the central plate 91 is sharp ie.

there is an included angle of 30° between respective opposed sides of the plate 91 at the edge 101. Outlet edges 103 and 105 of respective plates 93 and 95 are disposed 2 to 3 mms. above the edge 101 of the plate 91. There is a blunt included angle of 120° between an outer side of the plate 93 and an outer side of the plate 95 in the region of the outlet means (i.e. in the region where each outer side slopes inwardly and downwardly towards an edge 103 or 105).

In use of the sprayhead of FIG. 13 it is found that the sharp edge 101 of the central plate 91 results in an intense electrical field sufficient to give good atomisation. On the other hand, the large angle between the outer sides of respective plates 93 and 95 produces an electrical field such that there is a high potential gradient only in a vertically downwards or substantially vertically downwards direction. Liquids therefore emerge from the sprayhead in a narrow, well-defined stream.

The sprayhead of FIG. 13 may have plates of conducting or semi-conducting material or it may have insulating plates with electrodes in the form of metal inserts.

A further sprayhead according to the invention has annular outlet means, as is the case for the sprayhead of FIG. 7. In this further sprayhead, however, the intermediate tubular element corresponding to the element 43 of FIG. 7 has an outlet edge which is 2 to 3 mms. below the outlet edges of the radially inner and outer elements. Moreover, when viewed in axial section (as shown in FIG. 7) there is an included angle of 20° between radially inner and outer sides of the intermediate element in the region of the outlet edge. Between a radially outer side of the outer element and a radially inner side of the inner element there is an included angle of 90°.

In general, it is found that satisfactory results for the sprayhead of FIG. 13 and the corresponding sprayhead with annular outlet means can be obtained with an included angle of 10° to 60° for the sharp edge of the central plate or intermediate element and 80° to 150° for the included angle between the relevant sides of the other plates or elements.

In each of the above sprayheads it is found that an electrical field of 5 to 30 KV/cm. is sufficiently high to draw liquids from the sprayheads in the form of filaments.

Each of the sprayheads shown in FIGS. 4 to 13 may be provided with electrode elements, as in the sprayhead of FIG. 4. In the case of the sprayhead of FIG. 7, ring-shaped electrode elements are provided.

Each of the apparatus described above can be used for mixing a variety of different liquids.

First, the apparatus is suitable for coating articles with a material formed from a mixture of two liquid components which react together rapidly to form a solid. However, the reaction time must be sufficient for the or each filament emerging from the sprayhead to remain in liquid form until the filament has become unstable and broken up into charged liquid droplets. Solidification must then take place after the droplets have landed on an article to be coated.

Liquids which can be used are monomers and/or prepolymers with or without catalysts, blowing agents and pigments.

Examples are (1) Polymeric foams such as polyurethane, where the liquid components are polyol and di-isocynate, one or each dissolved in a blowing agent.

(2) Rapidly curing two-pack paint systems.

(3) Thin polymeric films such as silicone coatings, where the liquid components may be 50% silicone polymer, dissolved in a solvent with 4% of a platinum catalyst, and 50% silicone polymer, also dissolved in a solvent and with 4% of a silicone cross-linking polymer.

(4) Two-pack adhesive systems.

The article or target coated by such materials may be hand-held. In this case, the apparatus is particularly suited for use in coating articles of complex shape. Hard coatings are readily applied.

Alternatively, the article may be a sheet moving along a production line. A sprayhead having a linearly extending outlet, transverse to the direction of movement of the sheet is then particularly suitable.

Secondly, each of the apparatus described above can be used to make articles in the form of beads or filaments. In the case of beads, the liquid components must react together to form a solid after each liquid filament has broken up into charged liquid droplets but before the droplets have landed on a target. In the case of filament production, the liquid components must react together to form a solid filament before each liquid filament from the sprayhead has had time to break up into charged droplets. The resulting solid filament is continuously wound on to a support at the rate at which it is being produced. It will be apreciated that liquids having a fast reaction time can be employed.

Thirdly, each apparatus described above can be used to effect atomisation of physically incompatible liquids. An example arises in agricultural and other kinds of spraying, where it may be desirable to spray together a colloid and a liquid which, upon contact with colloid, would cause it to flocculate. With the above apparatus, the colloid does not contact the liquid until they are emerging from the sprayhead. There is then no time for the colloid to be degraded by flocculation.

Finally, each apparatus can be used to spray a liquid whose electrical properties, for example resistivity, would otherwise render the liquid unsuitable for electrostatic spraying. In this case, the apparatus is supplied with the spraying liquid and with a carrier liquid of appropriate resistivity. Such apparatus is particularly useful for agricultural spraying.

I claim:

1. An apparatus for the electrostatic spraying of a mixture of a plurality of liquids, the apparatus comprising a sprayhead formed with a plurality of channels, each channel having a separate inlet connectable to a supply of liquid separate from supplies to other of said channels, and each channel communicating with a common outlet means, the channels being so arranged that each of the said liquids flows through a respective one of the channels and the said liquids meet at said common outlet means only outside the channels, and means for subjecting liquids emerging from the outlet means to an electrical field sufficiently high for a mixture of liquids to be drawn from the sprayhead in the form of at least one filament, the said at least one filament containing a mixture of liquids in proportions substantially equal to the proportions in which they were supplied to the apparatus.

2. An apparatus as claimed in claim 1, wherein the sprayhead comprises a series of mutually spaced plates, and each channel is formed by the space between a pair of adjacent plates and the outlet means comprise an outlet edge of each of the plates.

3. An apparatus as claimed in claim 2, wherein the sprayhead comprises a central plate and two outer plates, a channel is formed between each outer plate and the central plate, and the outlet means comprises an outlet edge of each of the plates, the outlet edge of the central plate being located downstream of the outlet edges of respective outer plates.

4. An apparatus as claimed in claim 3, wherein an angle which is included between opposed sides of the central plate at the outlet edge thereof is smaller than the included angle between outer sides of respective outer plates.

5. An apparatus as claimed in claim 4, wherein the said angle between opposed sides of the central plate is between 10° and 60°, and the angle between outer sides of respective outer plates is between 80° and 150°.

6. An apparatus as claimed in claim 1, wherein the sprayhead comprises a series of coaxially arranged, generally tubular elements, and each channel is formed by a space of generally annular section between two adjacent elements and the outlet means comprise axially outer edges of respective elements.

7. An apparatus as claimed in claim 6, wherein the sprayhead comprises radially inner, intermediate and outer guide elements, and the outlet means comprises axially outer edges of respective elements, the axially outer edge of the intermediate element being located downstream of the axially outer edges of the inner and outer elements.

8. An apparatus as claimed in claim 7, wherein an angle which, in an axial section of the sprayhead, is included between opposed sides of the intermediate element at the axially outer edge thereof is smaller than the angle between a radially outer side of the outer element and a radially inner side of the inner element.

9. An apparatus as claimed in claim 8, wherein the said angle between opposed sides of the intermediate element is between 10° and 60°, and the said angle between the radially outer side of the outer element and the radially inner side of the inner element is between 80° and 150°.

10. An apparatus as claimed in claim 1, wherein the sprayhead comprises a body having a generally conical tip, and each channel extends through the body to an outlet at the tip of a the body and the outlet means comprise the outlets of respective channels.

11. An apparatus as claimed in claim 1, wherein the outlet means comprise a surface of at least semi-conducting material, and the means for subjecting the liquids to an electrical field comprise means for applying an electrical potential to the said surface.

12. An apparatus as claimed in claim 1, wherein the outlet means is formed of non-conducting material, and an electrode is arranged a short distance upstream of the outlet means and at a location such that the electrode is contacted, in use, by at least one of the liquids, the means for subjecting the liquids to an electrical field comprising means for applying an electrical potential to the said electrode.

13. An apparatus as claimed in claim 1, wherein an electrode is mounted adjacent the sprayhead, and the means for subjecting liquids emerging from the outlet means to an electric field comprise means for causing a first potential to be applied to the liquids and means for maintaining the electrode at a second potential, the difference between the first and second potentials being sufficient to cause formation of said at least one filament.

14. An apparatus as claimed in claim 13, wherein, for spraying a target at zero potential, the first potential is 1 to 20 KV and the second potential is at or near earth potential.

15. An apparatus as claimed in claim 13, wherein, for spraying a target at zero potential, the first potential is 25 to 50 KV and the second potential is 10 to 40 KV.

16. An apparatus as claimed in claim 13, wherein the electrode comprises a core of at least semi-conducting material sheathed in a material of dielectric strength and volume resistivity sufficiently high to prevent sparking between the electrode and the sprayhead and of volume resistivity sufficiently low to allow charge collected on the surface of the sheathing material to be conducted through that material to the at least semi-conducting core.

17. An apparatus as claimed in claim 16, wherein the volume resistivity of the sheathing material is between $5\times10^{11}$ and $5\times10^{13}$ ohm. cms., the dielectric strength of the sheathing material is greater than 15 KV/mm. and the thickness of the sheathing material is 0.75 to 5.0 mms.

18. An apparatus as claimed in claim 16, wherein the thickness of the sheathing material is 1.5 to 3 mms.

19. An apparatus as claimed in claim 16, wherein the specific resistance of the sheathing material is between $5\times10^{10}$ and $5\times10^{12}$.

20. An apparatus as claimed in claim 1, comprising means for supplying a plurality of liquids to the sprayhead such that said at least one filament becomes unstable and breaks up into charged droplets a short distance away from the outlet means.

21. An apparatus as claimed in claim 20, wherein means are provided for causing a stream of gas to flow through the region of the high electrical field, the direction and velocity of the stream of gas being such that charged droplets of liquid are removed from the said region, thereby to reduce a build-up in space charge which affects the magnitude of the electrical field.

22. An apparatus as claimed in claim 21, wherein the velocity of the stream of gas is approximately equal to or greater than the velocity of the droplets in the absence of the stream of gas.

23. An apparatus as claimed in claim 1, comprising means for supplying a plurality of liquids to the sprayhead such that the mixture of liquids remains in the form of at least one filament until striking a target.

24. A process for the electrostatic spraying of a plurality of different liquids comprising supplying each of the different liquids to respective channels in a sprayhead, each channel communicating with an outlet means at which the liquids flowing through respective channels meet, and subjecting liquids emerging from the outlet means to an electrical field sufficiently high for a mixture of liquids to be drawn from the sprayhead in the form of at least one filament containing a mixture of liquids in proportions equal to the proportions in which they were supplied.

25. An apparatus for the electrostatic spraying of a mixture of a plurality of liquids, the apparatus comprising a sprayhead formed with a plurality of channels, each channel having an inlet and each channel communicating with an outlet means, means for supplying the said liquids to respective inlets of the channels, whereby the liquids flow through respective channels and meet at the outlet means, and means for subjecting liquids emerging from the outlet means to an electrical field sufficiently high for a mixture of liquids to be drawn from the sprayhead in the form of at least one filament, said at least one filament containing a mixture of liquids in proportions substantially equal to the proportions in which they were supplied to the apparatus.

26. Apparatus for electrostatically spraying in plurality of different liquids in the form of a mixture of the different liquids, said apparatus comprising a sprayhead having a plurality of discrete flow channels, each channel having an inlet end for receiving a respective different liquid from a supply thereof and each channel having an outlet end communicating with a common outlet means for merging liquids flowing from said outlet ends of said channels, and means for subjecting liquids at said outlet means to an electrical field sufficiently high for a mixture of liquids from different channels to be drawn from the outlet means in the form of at least one filament which contains different liquids in proportions substantially equal to the proportions in which they were supplied to said inlet ends of said channels.

* * * * *